US005108544A

United States Patent [19]

Hakansson

[11] Patent Number: 5,108,544

[45] Date of Patent: Apr. 28, 1992

[54] METHOD FOR PICKLING IRON AND STEEL SURFACES

[76] Inventor: Lars A. H. Hakansson, Lindöhällsvägen 15, S-603 65 Norrköping, Sweden

[21] Appl. No.: 597,686

[22] Filed: Oct. 16, 1990

[30] Foreign Application Priority Data

Oct. 19, 1989 [SE] Sweden ..... 8903452

[51] Int. Cl.[5] ..... B44C 1/22; C23F 1/00

[52] U.S. Cl. ..... 156/664; 134/3; 134/41; 252/79.4

[58] Field of Search ..... 252/79.4, 142, 148; 156/656, 664; 134/3, 41

[56] References Cited

U.S. PATENT DOCUMENTS 2,959,494 11/1960 Shepard ..... 117/50
4,460,479 7/1984 Mulder ..... 252/79.4
4,873,014 10/1989 Long ..... 252/148

FOREIGN PATENT DOCUMENTS 364218 10/1981 Austria .
1621547 5/1971 Fed. Rep. of Germany .
1301482 7/1962 France .
2296024 7/1976 France .
372956 1/1975 Sweden .
7701734 6/1979 Sweden .
802894 10/1958 United Kingdom .
1456823 11/1976 United Kingdom .
2165495 11/1985 United Kingdom .

OTHER PUBLICATIONS

Chemical Abstracts, vol. 89, No. 8, 1978.
Chemical Abstracts, vol. 83, No. 14, 1975.
Chemical Abstracts, vol. 97, No. 8, 1982.

*Primary Examiner*—William A. Powell
*Attorney, Agent, or Firm*—Cushman, Darby & Cushman

[57] ABSTRACT

A method for pickling and/or etching iron and steel surfaces, in which the surfaces are treated in a pickling bath which contains inhibitors, mineral acids and metal salts of the anions of the acids. The inhibitor used is a mixture of tensides, silicates, phosphates and possibly oils, and the surfaces are preferably coated with inhibitor prior to being treated in the pickling bath. The surfaces are preferably first degreased with an aqueous tenside solution, therewith to emulsify hydrocarbons, such as grease and oils. Growth of microoganisms is stimulated for biological degradation of the hydrocarbons, by adding nutrient substances, whereafter the surfaces are treated in the pickling bath without intermediate rinsing.

14 Claims, 1 Drawing Sheet

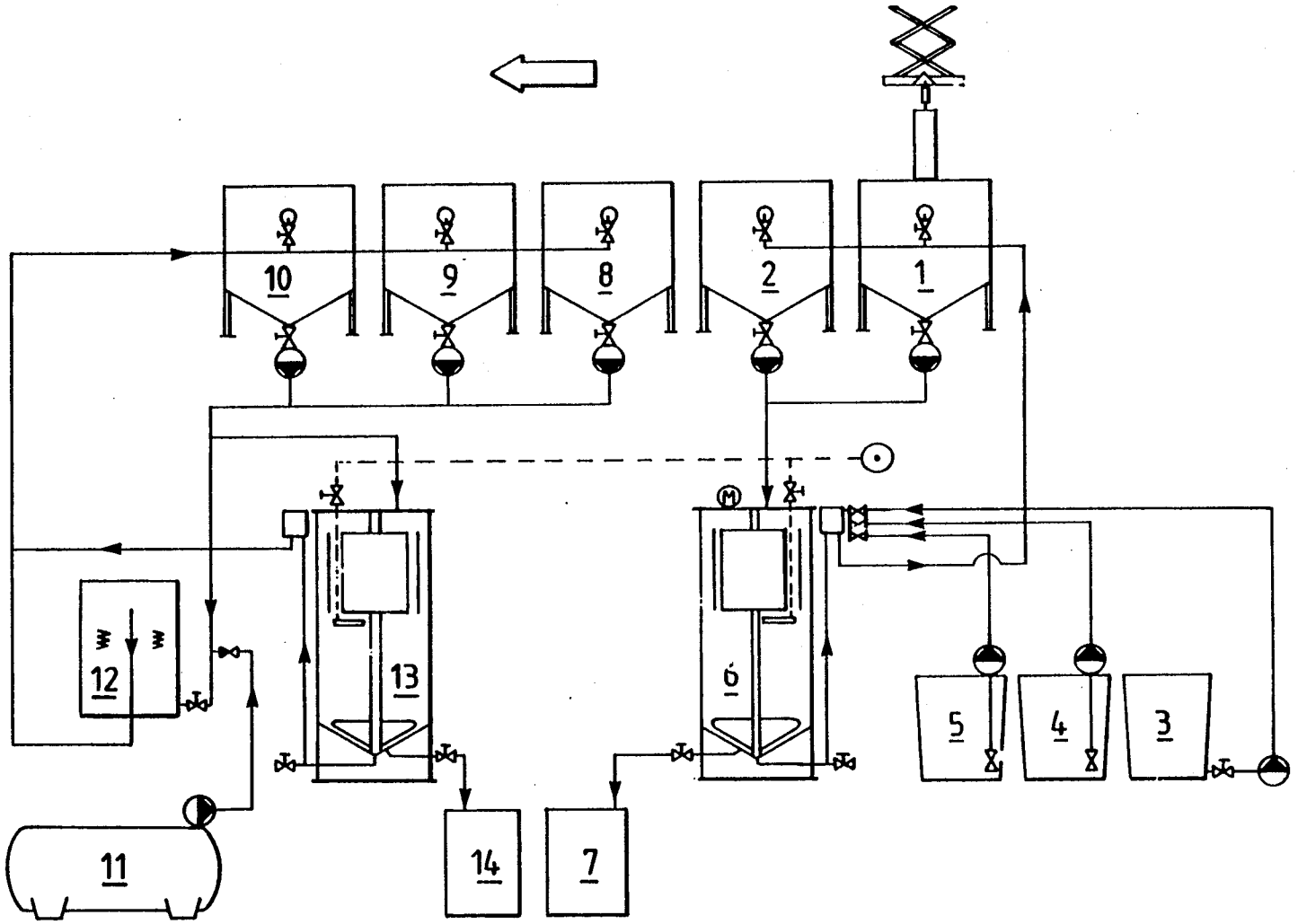
1
2
8
9
10
3
4
5
6
7
14
13
12
11

METHOD FOR PICKLING IRON AND STEEL SURFACES

BACKGROUND OF THE INVENTION

The present invention relates to a method for pickling and/or etching iron and steel goods which are to be further worked, e.g. which are to be zink-coated or electro-plated.

The goods concerned most often consist of hot and cold rolled steel which during the working processes to which it is subjected becomes contaminated with oil, grease, weld-sprays, etc. The major part of hot-rolled steel is covered with a rolling skin (scale), and hence the product produced from the steel material will have mixed surfaces of pure steel and scale.

This scale must therefore be removed, in order to obtain a steel surface suitable for surface treatment. The scale can be removed by means of a number of methods, for instance by sand blasting, grinding, scale-splitting or pickling techniques.

Although sand-blasting and grinding may be the most suitable processes in the case of many products, these processes are often much too expensive when the surfaces to be cleaned are large.

BRIEF DESCRIPTION

The invention is further described hereinbelow with reference to the attached drawing, wherein:

The FIGURE is a schematic diagram of a set of apparatus for pickling iron and steel surfaces using a method embodying principles of the present invention.

Although scale-splitting is an excellent method in this regard, it is necessary to induce some form of tension in the material, so that when split, the scale will drop therefrom. Thus, in the case of thicker goods, or goods where the surfaces thereof cannot be treated mechanically, only pickling methods remain. These methods can be readily classified in the base acids salpeter. Sulfuric acid, phosphoric acid and hydrochloride acid.

Pickling with nitric acid is expensive and results in troublesome emissions, and is mostly used together with hydrofluoric acid when pickling alloyed steels.

Sulfuric acid is often used for pickling purposes, because the acid is able to work at high temperatures and in short pickling times without generating troublesome emissions. The drawback with sulfuric acid, however, is that is cannot be readily rinsed from the pickled surfaces of the goods and requires the provision of large rinsing units.

Phosphoric acid is mostly used as an acid additive to other pickling acids and is not used for conventional pickling purposes, among other reasons because of its high price.

Hydrochloric acid is the acid that is most suitable for pickling iron, since this acid is relatively cheap. Also, it can be readily rinsed from the pickled surfaces and is highly effective in dissolving scale at high temperatures. The drawback with hydrochloric acid, however, it that strong emissions are generated at elevated temperatures, which renders the pickling process impossible to carry out safely, unless the process is totally encapsulated.

These known pickling processes require ling pickling times and result in very rapid dissolution of the free iron present, whereas the time taken to dissolve the scale may be ten times as long. Consequently, the free iron-surface is often completely leached of pure iron and obtains a crater-like structure consisting of coke, slag, etc. which is not soluble in the acid. Subsequent to being subjected to a pickling process of this kind, the resultant iron surface will exhibit a total spectra extending from pure iron to its slag products.

It is not possible to effect qualitative treatment in many cases of surface treatment, such as hot-dip galvanizing processes, electro-plating processes, etc., because the iron surface is changed so radically.

For instance, in the case of hot-dip galvanizing, there is no pure iron which can alloy with the zinc, and instead, the goods being treated are coated solely with zinc, which results in high zinc consumption and white rust.

White rust is a direct result of deep pickling pockets present in the iron surface and containing pickling-bath residues which have not been rinsed away.

The same problems are found with electrolytic surface treatment processes and chemical surface treatment processes, although the problems are minimized with these processes because cold drawn steel is used.

SUMMARY OF THE INVENTION

These drawbacks are avoided with a method in accordance with the invention for pickling and/or etching iron and steel surfaces in which the surfaces are treated in a pickling bath which contains inhibitors, mineral acids and metal salts of the anions of the acids, which is characterized in that the inhibitors is a mixture of tensides, silicates, phosphates and possibly oils, and in that the surfaces are preferably coated with inhibitor prior to being treated in the pickling bath.

DETAILED DESCRIPTION

Examples of acids which can bu used are $H_2SO_4$, $HNO_3$, HF, HCl and mixtures thereof.

The mineral acids are used together with tenside additions; in accordance with the following.

Prepickling heavily scaled goods:
10% $H_2SO_4$+3–6% NaCl
Tenside 1–2% by weight
Temperature 60°–80° C.
Pickling time 3–6 min.

Final pickling:
10% $HNO_3$+2–4% HF
Tenside 1–2% by weight
Temperature 20°–40° C.
Pickling time 4–6 min.

Passivation:
20% $HNO_3$
Tenside 0.5–1% by weight
Temperature 20°–30° C.
Treatment time 10–20 min.

When pickling stainless steel, hydrofluoric acid is added in order to accelerate the dissolution of chromium and nickel oxides, which does not normally take place as quickly as the dissolution of iron and iron oxide (FeO).

There is preferably used an aqueous solution which contains 22–32% by weight $FeCl_2$ and up to 8% by weight HCl, preferably 1–4% by weight, particularly 1–2% by weight HCl, 1–15% by weight tenside, in particular 1–5% by weight tenside, 0.1–10% by weight silicates, especially 0.1–0.5% by weight silicates, 0.1–10% by weight phosphates, especially 0.1–5% by weight phosphates and 25–1000 mg oils/ml.

The high proportion of $FeCl_2$ in the pickling bath results in elevated solubility of the scale present. At the same time, the acid content of the bath is lowered to 1–8%, so that the acid-iron content of the bath will be as low as possible. There is obtained therewith a condition which enables the dissolution rate between scale and pure iron to be controlled. Furthermore, acid emissions are minimized, so as to enable pickling to be carried out in an open system. The surfaces of the goods thus treated are smooth and silk-mat, and are completely devoid of pits or crevases, due to the special mixture of tensides, silicates, phosphates and possibly also oils.

The process as a whole is based on the principle of pre-coating the surfaces of the goods with an inhibitor which functions to effectively block the surfaces so as to prevent the bath acid from attacking the free iron.

The method is assumed to have the following effects on the iron surfaces. When the goods come into contact with the pickling bath, the surfaces of the goods are protected by the inhibitor layer, which only allows small quantities of the free acid to pass therethrough. Presumably, this is because hydrogen gas is generated upon contact of the iron with the acid, and that this gas, together with the inhibitor, effectively prevents the admission of new acid.

The primary reason for the elevated scale-dissolution rate is because the pickling acid, which has a high salt content and a low acid content and an elevated temperature, penetrates through pores and cracks in the insoluble ferrioxide layers and magnetite layers and attacks the underlying wustite layer, which is rapidly dissolved and loosens the overlying layers of scale from the steel surfaces.

This takes place rapidly, owing to the formation of small galvanic elements from iron particles and iron salts as anodes, acid as electrolyte and the magnetite layer as the cathode, during which hydrogen gas is generated and accelerates the dissolution and loosening of the scale layer.

The major part of the hydrogen generated departs in molecular form and is bound in the pickling bath by inhibitors.

The active and non-degradated inhibitor blocks the hydrogen which normally diffuses in atomic form into the metal and causes hydrogen brittleness, owing to the fact that the inhibitor immediately binds the hydrogen generated from the dissolution of metal to form a protective and insulating layer, so as to block immediately renewed dissolution of the atomic iron on the surfaces of the goods.

When the temperature of the bath is raised, the dissolution of scale is accelerated, whereas the dissolution of pure iron is delayed, primarily because of the low acid content which is unable to penetrate the hydrogen bubbles which are held in the inhibitor layer. It is possible to work at a temperature of up to 80° C. Temperatures of up to 60° C., preferably 25°–40° C., particularly 30°–40° C., are used in practice.

The tenside consumption increases with temperature. With temperatures of up to 40° C., 1–2% by weight tenside are required, whereas at temperatures of 40°–60° C. the tenside requirement is 2–4% by weight, and at 60°–80° C. 4–8% by weight. These contents relate to non-degradated tenside. The acid gradually breaks down the tenside, whereupon its inhibitor effect ceases. Consequently, it is necessary to add fresh tensides, so as to maintain the aforesaid contents. This is preferably effected by transfer from a preceding degreasing bath which contains tensides.

Because of the low production of hydrogen gas (low iron dissolution), the emission of hydrochloric acid when practising the aforesaid pickling method is practically non-existent.

The described invention also solves those corrosion problems which normally prevail when the bath contains high proportions of trivalent iron.

Because the steel surfaces are coated with a layer of inhibitor prior to being immersed in the pickling bath, attack by trivalent iron salt is also blocked.

This results in a pickling process in which the steel surfaces are coated with a filter and in which the density of the filter can be determined completely by the concentration of the inhibitor.

The goods are preferably dipped into a water solution containing tensides, silicates, phosphates and possibly oils, prior to the pickling process.

According to one particular embodiment of the present invention, however, the goods are first degreased with a tenside solution containing phosphates and silicates, while biologically degrading oils and grease, in accordance with Swedish Patent Application 8801511-0. The goods are then passed to the pickling bath, without being rinsed or washed. When practising this embodiment of the method, the goods are degreased by treating them with an aqueous tenside solution, whereupon with the hydrocarbons are emulsified, and nutrients are added so as to initiate the growth of microorganisms for the biological degradation of the hydrocarbons.

In order to initiate a cleaning process of this kind, it is necessary first to accumulate a given amount of organic substances such as oil and accompanying bacteria, prior to activation of the bacteriological life. The oil is preferably accumulated in the cleaning bath, by adding thereto a tenside solution of basic pH 7–14, particularly by adding a basic tenside solution of pH 9–11.

Cleaning can be effected with any kind of water-soluble tenside whatsoever, such as anionic, cationic, non-ionic and amphoteric tensides. These can be tensides which are not-readily degradable by microorganisms, such as the halogen-containing (chloro-bromo- and fluoro-containing) tensides and heterocyclic tensides. Biodegradable tensides are preferably used, however, so that sludge and slime, separated from the process will not contaminate the surroundings. It is correct procedure, however, to control the process so that the microorganisms will not degrade the tensides. This control of the process is preferably effected by ensuring that the hydrocarbon content of the bath will not fall beneath about 25 mg/liter and that the tenside content will not rise above 15% by weight. By processing in this way, it is ensured that the microorganisms will substantially degrade the organic contaminants present under all conditions and that the tensides are practically unaffected and regenerated and can be reused. The tensides should work at a pH of 7 up to an alkaline pH-value which will not block microbial growth. This pH-value is, at present, about 9.5, but may conceivably increase through genetic manipulation of the microorganisms. It has been found that good cleaning and degreasing results are achieved at alkaline pH-values above 8.5.

It is also possible to draw off part of the cleaning liquid and to allow biodegradation to take place in a separate unit or facility. In this case higher alkaline pH-values can be used in the actual cleaning bath. Thus, when the cleaning and biodegradation processes are effected separately, the cleaning process can be carried out at pH-values of from 7 to 14. When the cleaning processes and biodegradation processes are carried out in one and the same bath, the pH-value is preferably adjusted to between 9.0 and 9.5.

Because organic substances such as oil and grease and emulsified continuously in the bath, the pH-value will decrease as a result of tensides being consumed and bound by the emulsified substances. When the pH-value has fallen to about 9.2–9.4, careful metering of nutrient solution to the bath can be commenced, so as to activate the latent bacteria culture in the bath. In the case of systems having a volumetric capacity of 2 $m^3$, the system should be activated immediately, whereas systems having volumetric capacities on the order of 50–100 $m^3$ should not be activated until the oil content of the bath has risen to about 500–1000 mg/liter.

It is also important that fresh tensides be metered continuously to the bath, such as to maintain a constant tenside content and emulsifying capacity. The tenside content is preferably maintained at between 1–15% by weight, preferably between 2–5% by weight in the case of objects soiled to normal levels, and between 5 and 10% by weight in the case of heavily soiled or contaminated objects. When the cleaning and biodegradation processes are carried out separately from one another, the tenside content of the cleaning bath may be maintained at a high level, while the bath in which biogradation takes place is maintained at the aforesaid tenside level.

The content of organic substances should not fall beneath about 25 mg/ml in the biodegradation process, since bacteria can begin to consume the tensides at lower contents of organic contaminants. In the case of large bacteria populations, the pH-value may fall rapidly as a result of the high consumption of emulsifying chemicals and also as a result of acid generation by dead bacteria. The contaminant content such as oil and grease should be maintained between 25–1000 mg/ml, preferably between 50 and 250 mg/ml, by adding to the system nutrient substances and pH-increasing substances.

The temperature has also a decisive significance on optimum cleaning capacity. When the cleaning and biodegradation processes are effected separately from one another, the temperature of the cleaning bath may be between 20° and 100° C. When cleaning and biodegradation are effected in one and the same bath, the bath should be maintained at a temperature of between 20° and 80° C., preferably between 30° and 40° C., and more preferably between 35° and 40° C., which has been found to be a splendid working range in the case of mesophilic bacteria. Good cleaning results are obtained in this temperature range while, at the same time, the low temperature used requires only a low energy point. In the case of certain degreasing processes used, for instance, to remove waxes and paraffins, the degreasing temperature must lie above 50°–60° C., in which case it may be suitable to use separate facilities for degreasing and biodegradation purposes.

Conversion of the bacteria population takes place more rapidly at temperatures above 40° C., at which preferably thermophilic bacteria are active, and consequently the content of organic contaminants should lie above 300 mg/liter in order to prevent the bacteria from attacking the degreasing chemicals.

A high degree of bacteria activity is required when large quantities of organic contaminants enter the bath. Large numbers of bacteria are also killed therewith. Certain bacteria species, when dead, produce toxic substances which are liable to destroy the biological life. Consequently, it is essential to separate dead bacteria continuously from the cleaning path. Since dead bacteria have a low sedimentation rate (about 0.1 m/h) their separation from the bath may at times prove troublesome. The separating apparatus described in Swedish Patent Specification 7701734-1 is preferably used in this regard. This specification is hereby incorporated as a reference.

The method is preferably made aerobic by introducing air, which can be atomized with the aid of nozzles.

The tensides used in accordance with the invention are described in more detail hereinafter, wherein in the formulae recited R is an alkyl residue having a long chain with 8–20 carbon atoms, R' is a short alkyl residue having 1–8 carbon atoms or H, and X is an alkylene residue, particularly $-(CH_2)_n$ when n is 1, 2 or 3.

The tensides used in accordance with the invention may be anoinic tensides, such as detergents and soaps, e.g. salts of carboxylic acids, suitably alklai, particularly potassium salts and amine salts (mono-, di- and triethanol amine salts), morpholine salts of fatty acids R-COO-, particularly having 12, 13, 14, 15, 16, 17 and 18 carbon atoms. There are also used salts of carboxylic acids having inserted ether-, carbon-, amide-, ester- and sulfonamide groups.

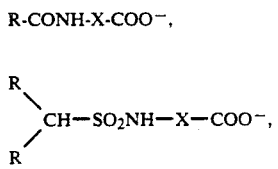

Sulfuric acid esters can also be used, such as sulfated oils and fatty acids, such as sulfuric acid esters

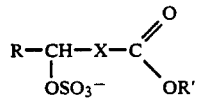

sulfated amides

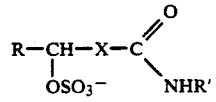

alkyl sulfates

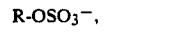

sulfated fatty acids monoglycerides of the formula $$R-COO-CH_3-\underset{\underset{OH}{|}}{CH}-CH_2-OSO_3^-,$$

sulfated fatty acid alkylene amides $$R\text{-}COHN\text{-}X\text{-}OSO_3^-,$$

sulfated ethers $$R\text{-}O\text{-}X\text{-}OSO_3^-.$$

Alkyl sulfonates can also be used, such as simple alkyl sulfonates $$R-\underset{\underset{SO_3^-}{|}}{CH}-R'$$

sulfosuccinic acid esters $$-O_3S-\overset{\overset{CH_2COOR}{|}}{CH}-COOR.$$

alkyl sulfonates having intermediate groups X $$RCOO\text{-}X\text{-}SO_3^-,$$

$$R-\underset{\underset{R'}{|}}{CON}-X-SO_3^-$$

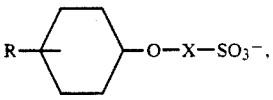

alkyl phosphates $$R\text{-}O\text{-}PO_3.$$

Alkylaryl sulfonates can also be used, such as alkyl naphthalene sulfonates

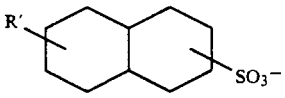

and alkyl benzene sulfonates

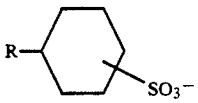

and alkyl phosphates and salts of alkyl benzene phosphonic acids

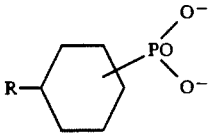

According to the invention there are also used cationic tensides, particularly with chlorine or methylsulfate ions as anions, e.g. amine salts, primary, secondary and teriary amine salts $$R-\overset{+}{N}H_3',$$

$$R-\overset{+}{N}H_2-R',$$

$$R-\overset{\overset{+}{|}}{N}H-R',$$
$$\quad\;\; \underset{\underset{R'}{|}}{}$$

primary, secondary and tertiary amine salts with intermediate ions X $$R-COO-X-\overset{+}{N}HR_2',$$

$$R-CONH-X-\overset{+}{N}HR_2',$$

$$R-O-X-\overset{+}{N}HR_2',$$

quarternary ammonium salts $$R'-\overset{\overset{R'}{|}}{\underset{\underset{R'}{|}}{N'}}-R'$$

also with intermediate molecules X as for the amine salts, phosphonium salts $$R-\overset{\overset{R'}{|}}{\underset{\underset{R'}{|}}{P}}-R',$$

and sulfonium salts $$R-\overset{\overset{R'}{|}}{\underset{\underset{R'}{|}}{S}}\;+$$

Amphoteric tensides can also be used, such as betaines $$R-\overset{\overset{R'}{|}}{\underset{\underset{R'}{|}}{N}}-\overset{+}{X}-COO^-,$$

sulfobetaines $$R-\overset{\overset{R'}{|}}{\underset{\underset{R'}{|}}{N}}-\overset{+}{X}-SO_3,$$

and sulfate betaines

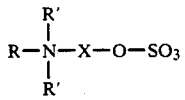

Nonionic tensides can also be used, such as ethylene oxide adducts, such as alkyl polyethylene glycols $R\text{-}(O\text{-}CH_2\text{-}CH_2)_n\text{-}OH,$ alkylene polyethylene glycols

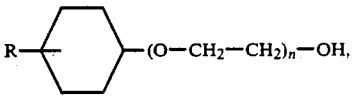

acyl polyethylene glycols $R\text{-}CO(O\text{-}CH_2\text{-}CH_2)_n\text{-}OH,$ n=1-60 oxyethylated polypropylene glycols

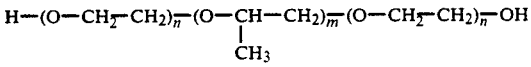

amine toxilate

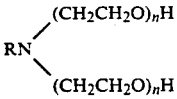

Among these compounds there are preferably used those which have a weak to average degree of oxyethylisation (n=about 0.3-0.7×c/2, where n is the number of moles ethylene oxide per mole of starting substance and c is the number of carbon atoms in the hydrophobic residue). Fatty acid monoglycerides are also used

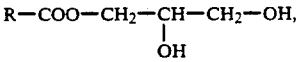

anhydrosorbite-monofatty acid esters $R\text{-}COO\text{-}C_6H_{11}O_4,$ fatty acid alkylene amides

R-CONH-X-OH,

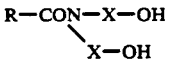

saccharose-monofatty acid esters $R\text{-}COO\text{-}C_{13}H_{21}O_{20}.$

These tensides can either be used individually or in mixtures. Cationic and nonionic tensides and mixtures thereof are used in particular, especially nondionic ethylene oxide adducts. Examples of tensides which can be used in this regard include 616 Allrent (contains nonionic tensides 2-nonyl-phenol, cationic tensides alkyl polyglycolether ammonium methyl sulfate, tetra potassium pyrophosphate, sodium citrate, preservatives, isopropanol, perfume, water and trisodium nitrilo triacetate). Via®, Surf®, Radion®, Meqquem 8510® (ethylene oxide adducts, glycols, phosphates, silicates, nonyl phenol.) These detergents often contain an alkaline substance which will not block microbiological growth and auxiliary washing agents such as polyphosphates.

The substances used to adjust the pH of the system shall be soluble in water, although they should not have a negative effect on the tensides and the microbiological conversion. Examples of such basic substances include alkali salts of basic pyrosulfates $M_4P_2O_7$, where M signifies an alkali or alklai metal, preferably potassium, polyphosphates, tripolyphosphate, metasilicates such as sodium metasilicate, and primary, secondary, tertiary amines, particularly water soluble and/or grease-emulsifying primary, secondary and tertiary alkanol amines preferably having 1-10 carbon atoms and optionally substituted on the alkyl part, e.g. mono-, di- and triethanolamine, 2-amino-1-butanol, 2-amino-3-methyl-propyl, 2-amino-2-methyl-1,3-propandiol, 2-amino-2-ethyl-1,3-propandiol, tris(hydroxyimethyl)amino methane and isopropanol amine. These alkali substances can be charged in mixtures with the tensides.

In the case of large bacteria populations, the pH-value may fall rapidly due to high consumption of emulsifying chemicals due to the generation of acid by dead bacteria. Consequently, in order to prevent the tenside-consumption from becoming excessive, the nutrient solution introduced to the bath may also contain a pH-increasing substance suitable for tensides, e.g. one of the aforementioned.

Preferably, sodium metasilicate or amines are used. Tensides based on sodium metasilicate are not suitable for use in a number of industrial surface-treatment processes, such as electrolytic processes for applying chromium, nickel and other metals. In the cases of these processes, the alkaline substance used must be based on amines.

The nutrient substances charged in accordance with the invention are those conventionally used for the cultivation of microorganisms. These substances shall contain N, S, Mg, K, P, and a carbon source, and may also contain trace metals such as Zn, Mn, Cu, Co, Mo. A suitable mixture will contain one part by weight $Mg^{2+}$, one part by weight $SO^{2-}$, 8 parts by weight $K^{4+}$, 32 parts by weight $PO^{3-}$, 80 parts by weight $NH^{+}$, a carbon source in the form of glucose 1600 parts by weight, minor quantities of zink, manganese, copper, cobalt and molybdenum, pH-increasing substances, e.g. alkali and pH-lowering acid, e.g. $H_3PO_4$, $O_2$ 3000 parts by weight in the form oxygen or air. The composition of the nutrient substances, however, forms part of the present state of the art and can be readily established by the skilled person.

When the articles are lifted out of such a biological degreasing path, they are coated with a water solution containing 1-15% by weight tensides, often 3-10% by weight tensides, 0.1-10% by weight silicates and 0.1-10% by weight phosphates and 25-1000 mg oils/ml, especially 50-250 mg oils/ml. This coat functions as a perfect inhibitor when pickling with acids.

The articles are moved, without being rinsed, to a pickling bath, which when the process is started, contains about 0.01–0.05% by weight silicates, 0.05–0.1% by weight phosphates and 0.05–0.1% by weight tensides as inhibitors. As more articles coated with the solution from the degreasing bath are introduced into the pickling bath, the contents of tenside, phosphate, silicate and oil are increased. The pickling bath may be used up to 1 year and the contents are kept at 1–14, especially 1–8 and preferably 1–5% by weight of tenside, 0.1–10%, especially 1–5%, preferably 1–2% by weight of silicate and phosphate and 25–1000 mg oil.

Greater amounts of inhibitors may be used, but the costs of especially the tensides may be a limit. One can also start with goods that have been degreased in some other way, e.g. with sodium hydroxide and rinsed, and coat them with the tenside mixture according to the invention before pickling with a bath that may contain the inhibitors, according to the invention. Alternatively, the goods may be treated directly with the pickling bath containing the inhibitors.

When degreasing a steel surface in a degreasing bath which contains 5% inhibitor and the steel surface is then pickled immediately, without being rinsed, with 25% iron chloride ($FeCl_2$), 4–6% hydrochloric acid (HCl), 1–2% inhibitor (Camex Bio 104) at a temperature of 30° C., the dissolution rate of a typical scale coating is about 30 min. The free iron surface is then practically totally undisturbed and obtains a silk-matt finish. The state of the steel surfaces are also completely unchanged, which means that a surface-treatment process of the highest quality can be carried out.

When carrying out a pickling process in which the bath components have the aforesaid relationships and the load of goods to bath is high, there is obtained dissolution of scale and also of pure iron which as a result of its intrinsic heat results in a temperature increase of 3°–4°.

When carried out in accordance with the aforegiven formula, the present invention is also able to accelerate the pickling of cold-drawn steel. This affords the advantage of enabling hard surface alloys to be quickly dissolved, because of the high salt content and the low acid content of the bath.

An oxidant can be added to the bath, for the purpose of accelerating the pickling/etching of cold-drawn steel. Dissolution of the iron alloys on the surfaces of the goods is accelerated when 0.1–0.3% nitric acid is metered to the aforedescribed pickling system. This is because, at the low hydrochloric-acid content of 4–6%, the free acid does not quickly attack the free iron on the surface, and solely rapid dissolution of steel of high carbon content takes place.

By increasing or decreasing the amount of nitric acid introduced when pickling cold-rolled steel, it is possible to control the amount of dissolved iron in relation to the iron content ($FeCl_2$) consumed in dissolving hard alloys.

When practising the novel, inventive pickling method, acid attack on the iron and steel surfaces is reduced so as to render subsequent working processes more effective. For example, when galvanizing the goods, the surfaces of said goods not only obtain the best possible smoothness, but a saving in zinc of up to 30% is also made. Furthermore, the proportion of acid in the bath can also be reduced, which enables the method to be practiced in open systems, which has not previously been possible due to the acid emissions resulting therefrom.

The invention will now be illustrated by means of a working example.

EXAMPLE

Degreasing (Reference is made to the accompanying drawing)

A degreasing bath was prepared from water and a 5%-tenside solution of Camex Bio 104. Camex Bio 104 contains 1–5% by weight sodium metasilicate, 5–10% by weight tetrapotassium pyrophosphate, 5–10% by weight Meqquem® (which consists of ethylene oxide adducts, glycoles, phosphates, nonylphenol and silicates) and the temperature was raised to 38° C.

Oxygen was delivered to the bath through air pipes, so as to vigorously agitate the bath. A well-agitated bath was obtained in this way, which is beneficial to rapid emulsification of contaminants. The air blown into the bath also served to add oxygen thereto. The bath had a pH of 10.5.

Goods were charged to degreasing tanks 1 and 2, which were charged with the liquid from tank 3. Each charge remained in the degreasing solution over a period varying from 5–20 minutes.

After about 10 days production, the bath had become enriched with oil, grease, etc., while the pH of the bath had fallen from 0.5 to 9.5–10.0.

It is now suitable to activate the bacteria which accompanies degreased goods into the bath. In the case of baths which measure up to 2 $m^3$ this is effected with an oil content of about 500 mg/ml and for larger baths with an oil content of about 1000–5000 mg/ml. Metering of Camex Bio 104-1 nutrient solution is then started, this solution being highly acid and lowers the pH to 9–9.2, which is appropriate for the bacteria population. This results in immediate activation of the oil-consuming bacteria present.

Camex Bio 104-1 contains 1.2 kg magnesium chloride
1.8 kg potassium chloride
2.6 liters sulphuric acid 37%
59 liters phosphoric acid 85%
40 kg ammonium chloride
25 kg glucose
500 liters of water It is desired to obtain a constant and controlled growth cycle of the bath bacteria. The pH of the bath is normally lowered spontaneously by the bacteria population. In order to prevent this from happening and in order to obtain a controlled pH-value, a pH of 9–9.2, a basic nutrient additive (Camex Bio 104-10) is added when necessary.

Camex Bio 104-10 contains 50 liters of the aforesaid Camex Bio 104-1
300 kg sodium lye 45%
350 liters of water.

These nutrient solutions are charged from the tanks 4 and 5 respectively.

Sludge is separated in the separator 6 and passed to the tank 7.

Initiation of activated pickling with hydrochloric acid

30%-hydrochloric acid is passed to the pickling tanks 8, 9 and 10 from the tank 11, through a heat exchanger 12 which heats the hydrochloric acid to 30° C., together with water in an amount sufficient to give the pickling bath a 15% concentration. 1% tenside solution Camex Bio 104 (see above) is introduced to the bath at the same time as the hydrochloric acid and water, so as to obtain the best possible admixture.

The bath is now ready to carry out a pickling process. Because Camex Bio 104 binds the hydrogen and acid ions present to the bath liquid, the pickling process takes place with practically no departure of acid from the bath.

The pickling process is commenced, by transferring goods from the degreasing baths 1 and 2 to the pickling tanks 8, 9 and 10, these goods being totally impregnated over surfaces and cavities dipped in the pickling bath. All surfaces are thus well protected and isolated for the electrolytic process which immediately commences for dissolution of the scale layer.

As a result of the high concentration of acid (15% by weight) in the bath, the scale layer is split and dissolved quickly. Atomic iron is also dissolved to some extent, due to the large quantity of acid in the bath, and the electrolytic function is lower at low iron-chloride contents.

Liquid is removed from the bottom of the tanks 8, 9 and 10 and passed to the separator 13 freed from sludge, which is tapped-off to the tank 14, whereafter fresh hydrochlorid acid is mixed with the solution and the solution returned to the tanks illustrated in the drawing.

Because both atomic iron and scale are dissolved, the iron-chloride content of the bath will increase progressively as pickling is continued in the bath. At the same time, the proportion of hydrochloric acid in the bath decreases, due to the fact that chloride ions depart during the dissolution process.

When the iron-chloride content has been increased to about 20% and the acid content has fallen to about 8% and the bath has a temperature of 30° C. the stage is reached at which dissolution of the atomic iron is at a low level and the scale layer is rapidly dissolved. The speed at which the scale layer is dissolved is quickest when the iron-chloride content is close to the degree of saturation of about 33–34% by weight and an acid content of about 1–2% by weight.

Accordingly, optimum dissolution of the scale layer is achieved with an iron-chloride content of 30–32%, which is controlled by tapping-off and at a low acid content, about 2–4%, which guarantees low dissolution of the atomic iron.

It is also possible to commence with degreased goods and immerse the goods in a 5% by weight tenside solution of Camex Bio 104 and then continue with the pickling process.

I claim:

1. A method for pickling iron and steel surfaces, comprising:

treating the surfaces in a pickling bath containing at least one inhibitor, mineral acids and metal salts of the anions of the acids; and said inhibitor comprising a mixture of tensides, silicates and phosphates.

2. A method according to claim 1, wherein: said inhibitor further includes oils.

3. A method according to claim 1, wherein:

said acid is selected from the group consisting of $H_2SO_4$, $HNO_3$, HF, HCl and mixtures thereof.

4. A method according to claim 2, wherein:

said surfaces are pickled with an aqueous solution containing 10–32% by weight $FeCl_2$, and up to 15% by weight HCl, 1–15% by weight tensides, 0.1–10% by weight silicates, 0.1–10% by weight phosphates and 25–1000 mg oil/ml.

5. A method according to claim 1, wherein:

the temperature of said bath is maintained above room temperature.

6. A method according to claim 5, wherein:

there are used 1–4% by weight tenside and a temperature of said bath, above room temperature, of up to and including 60° C.

7. A method according to claim 6, wherein:

0.1–0.3% by weight $HNO_3$ is added to the bath when pickling in hydrochloric acid.

8. A method according to any claim 1, wherein:

prior to said surfaces being treated in said pickling bath, said surfaces are first degreased by treating with an aqueous solution of tensides, therewith emulsifying hydrocarbons such as grease and oils; and growth of microorganisms is stimulated for biological degradation of the hydrocarbons, by adding nutrient substances, whereafter the surfaces are treated in said pickling bath without intermediate rinsing.

9. A method according to claim 8, wherein:

said degreasing is effected by maintaining the hydrocarbon content at 25–1000 mg/liter, by maintaining the tenside content at 1–15% by weight, by maintaining the temperature at 20°–80° C., by adjusting the pH-value to $>7$.

10. A method according to claim 2, wherein:

the inhibitor is an aqueous solution of 1–15% by weight tensides, 0.1–10% by weight silicates, 0.1–10% by weight phosphates and 25–1000 mg oil/ml.

11. A method according to claim 2, further comprising:

coating said surfaces with some of said inhibitor, prior to treating said surfaces in said pickling bath.

12. A method according to claim 1, further comprising:

coating said surfaces with some of said inhibitor, prior to treating said surfaces in said pickling bath.

13. A method according to claim 5, wherein:

0.1–0.3% by weight $HNO_3$ is added to the bath when pickling in hydrochloric acid.

14. A method according to claim 9, wherein:

during degreasing, said hydrocarbon content of said aqueous solution is maintained at 50–250 mg/liter, said tenside content of said aqueous solution is maintained at 3–10% by weight, and the pH of said aqueous solution is maintained between 8.5 and 9.7.

* * * * *